US005927819A

United States Patent [19]

Philipp et al.

[11] Patent Number: 5,927,819

[45] Date of Patent: Jul. 27, 1999

[54] METHOD AND DEVICE FOR TRIMMING AND END-ROUNDING BRISTLES

[75] Inventors: John K. Philipp, Lisbon; Jeffrey S. Meessmann; James A. Goranson, both of Iowa City, all of Iowa

[73] Assignee: Gillette Canada Inc., Kirkland, Canada

[21] Appl. No.: 08/807,717

[22] Filed: Feb. 28, 1997

[51] Int. Cl.[6] ..... A46D 1/08

[52] U.S. Cl. ..... 300/11; 300/21

[58] Field of Search ..... 300/2–11, 21

[56] References Cited

U.S. PATENT DOCUMENTS

| | | |
|---|---|---|
| Re. 27,455 | 8/1972 | Lewis . |
| 132,031 | 8/1872 | Stone . |
| 413,788 | 2/1889 | Nimschke . |
| 562,930 | 6/1896 | Shrady . |
| 764,898 | 7/1904 | Mumford . |
| 824,503 | 6/1906 | Morrison . |
| 985,806 | 3/1911 | Hoover et al. . |
| 2,244,615 | 6/1941 | Garcin . |
| 2,351,344 | 6/1944 | King . |
| 2,426,328 | 8/1947 | Wandel et al. . |
| 2,483,503 | 4/1949 | Pollack . |
| 2,554,777 | 5/1951 | Dangin . |
| 2,587,792 | 3/1952 | Von Sivers . |
| 2,672,640 | 3/1954 | Peterson et al. . |
| 2,876,477 | 3/1959 | Stewart . |
| 3,026,146 | 3/1962 | Szabo et al. . |
| 3,230,015 | 1/1966 | Iasillo . |
| 3,233,943 | 2/1966 | Peterson . |

(List continued on next page.)

FOREIGN PATENT DOCUMENTS

| | | |
|---|---|---|
| 2141958 | 8/1995 | Canada . |
| 0 273 117 | 8/1990 | European Pat. Off. . |
| 0 432 868 A2 | 6/1991 | European Pat. Off. . |
| 0 568 055 B1 | 11/1993 | European Pat. Off. . |
| 0 405 204 B1 | 9/1994 | European Pat. Off. . |
| 0 649 615 A1 | 4/1995 | European Pat. Off. . |
| 0 654 231 A1 | 5/1995 | European Pat. Off. . |
| 0 567 672 B1 | 9/1995 | European Pat. Off. . |
| 0 676 268 A1 | 10/1995 | European Pat. Off. . |
| 0 678 368 A1 | 10/1995 | European Pat. Off. . |
| 0 681 797 A1 | 11/1995 | European Pat. Off. . |
| 0 681 798 A1 | 11/1995 | European Pat. Off. . |
| 0 699 403 A1 | 3/1996 | European Pat. Off. . |
| 2032597 | 11/1970 | France . |
| 23 35 468 | 2/1975 | Germany . |
| 25 39 417 | 3/1976 | Germany . |
| 28 08 966 | 9/1979 | Germany . |
| 1 632 390 | 11/1980 | Germany . |
| 29 22 877 C2 | 12/1988 | Germany . |
| 91 07 687 | 8/1991 | Germany . |
| 40 29 160 A1 | 3/1992 | Germany . |
| 40 31 548 A1 | 4/1992 | Germany . |
| 43 30 171 A1 | 3/1995 | Germany . |
| 44 20 757 A1 | 12/1995 | Germany . |
| 295 15 391 U 1 | 4/1996 | Germany . |
| 195 25 808 | 1/1997 | Germany . |
| 1 400 028 | 7/1975 | United Kingdom . |
| 2 015 874 | 9/1979 | United Kingdom . |
| 1 592 574 | 7/1981 | United Kingdom . |
| 2 139 483 | 11/1984 | United Kingdom . |
| WO 94/27565 | 12/1994 | WIPO . |
| WO 95/26149 | 10/1995 | WIPO . |
| WO 95/27605 | 10/1995 | WIPO . |
| WO 95/28269 | 10/1995 | WIPO . |
| WO 95/30350 | 11/1995 | WIPO . |
| WO 95/30354 | 11/1995 | WIPO . |

*Primary Examiner*—Mark Rosenbaum
*Attorney, Agent, or Firm*—David A. Howley

[57] ABSTRACT

A method of trimming and end-rounding bristles and a device for carrying out the method are provided. The method includes providing a group of elongated continuous filaments arranged so that the longitudinal axis of each of the filaments is substantially parallel to the longitudinal axes of the other filaments and so that the ends of the filaments define a plane; advancing the group of filaments to an end-rounding device; end-rounding the group of filaments; and cutting the filaments to define a bundle of end-rounded filaments having a predetermined length.

24 Claims, 14 Drawing Sheets

U.S. PATENT DOCUMENTS 3,325,845 6/1967 Sawkiw .
3,355,839 12/1967 Clemens .
3,416,262 12/1968 Hazelton .
3,451,173 6/1969 Hazelton .
3,524,447 8/1970 Evans et al. .
3,545,025 12/1970 O'Connell .
3,554,880 1/1971 Jenkin .
3,711,908 1/1973 Broers .
3,774,782 11/1973 Lewis .
3,780,926 12/1973 Davis .
3,799,616 3/1974 Lewis .
3,818,534 6/1974 Boucherie .
3,836,199 9/1974 Blankschein .
3,910,637 10/1975 Lewis, Jr. .
3,941,424 3/1976 Balamuth et al. .
4,009,910 3/1977 Lewis, Jr. .
4,109,965 8/1978 Lewis, Jr. .
4,111,491 9/1978 Steinebrunner .
4,131,505 12/1978 Davis, Jr. .
4,132,449 1/1979 Bergman .
4,208,001 6/1980 Martner .
4,233,260 11/1980 d'Argembeau .
4,256,948 3/1981 Campbell et al. .
4,285,892 8/1981 Betsuda et al. .
4,291,431 9/1981 Lewis, Jr. .
4,360,236 11/1982 Boucherie .
4,390,384 6/1983 Turner .
4,430,039 2/1984 Boucherie .
4,441,227 4/1984 d'Argembeau .
4,592,594 6/1986 d'Argembeau .
4,609,228 9/1986 Bicket .
4,610,481 9/1986 Steinebrunner .
4,619,485 10/1986 Lewis, Jr. .
4,635,313 1/1987 Fassier et al. .
4,647,113 3/1987 Steinebrunner .
4,696,519 9/1987 Lewis, Jr. .
4,762,373 8/1988 Amos et al. .
4,838,639 6/1989 Morankar et al. .
4,869,277 9/1989 Olsen .
4,876,157 10/1989 Barman .
4,884,849 12/1989 Shaw ..... 300/21
4,904,025 2/1990 Steinebrunner et al. .
4,954,305 9/1990 Weihrauch ..... 300/21
4,979,782 12/1990 Weihrauch .
4,988,146 1/1991 Weihrauch .
5,030,090 7/1991 Maeda et al. .
5,033,797 7/1991 Rueb .
5,045,267 9/1991 Weihrauch .
5,143,424 9/1992 Boucherie .
5,143,425 9/1992 Boucherie .
5,158,342 10/1992 Pai .
5,163,348 11/1992 Kitada et al. ..... 83/349
5,165,759 11/1992 Lewis, Jr. .
5,165,761 11/1992 Dirksing .
5,176,427 1/1993 Weihrauch .
5,217,279 6/1993 Newell .
5,224,763 7/1993 Dirksing .
5,350,219 9/1994 Shou-Jen .
5,390,984 2/1995 Boucherie et al. .
5,431,484 7/1995 Zahoransky et al. ..... 300/21
5,458,400 10/1995 Meyer .
5,474,366 12/1995 Strütt et al. .

METHOD AND DEVICE FOR TRIMMING AND END-ROUNDING BRISTLES

BACKGROUND OF THE INVENTION

The present invention relates to methods and devices for trimming and end-rounding bristles, e.g., bristles used in toothbrushes.

Brushes of many types are formed by mounting a plurality of bristles, typically arranged in tufts, on a brush body so that the tips of the bristles together define a brushing surface. In many applications it is necessary to trim the bristles to a uniform length (or in some cases to different lengths to form a contoured brushing surface). Some applications further require that the tips of the bristles be "end-rounded", i.e., that the shape of the tips be altered from the typical blunt-cut flat tip surface that is present after trimming to a smooth, relatively hemispherical tip shape. End-rounding is particularly important when the bristles are to be used in a toothbrush, as the sharp edges of blunt-cut bristle tips may contribute to gingival abrasion and/or cause discomfort to the toothbrush user.

SUMMARY OF THE INVENTION

The present invention provides an improved process for end-rounding and trimming filaments, and cutting the end-rounded filaments to length to form bristles. The bristles are formed by providing continuous filaments of bristle stock, gathering the filaments together to form a group of filaments arranged so that the longitudinal axis of each filament is substantially parallel to the longitudinal axes of the other filaments and the ends of the filaments define a plane, end-rounding the ends of the filaments as they are held in the group, and cutting off a length of the grouped filaments to define a cut bundle. Advantageously, if desired the filaments can be fed to the device from a spool or other packaging on which the continuous filaments are wound or contained (e.g., an unwound hank), and the cut bundles can be transferred easily to a magazine from which the bristles are fed to a tufting machine.

In one aspect, the invention features a method of trimming and end-rounding bristles. The method includes (a) providing a group of elongated continuous filaments arranged so that the longitudinal axis of each of the filaments is substantially parallel to the longitudinal axes of the other filaments and so that the ends of the filaments define a plane; (b) providing a device for trimming and end-rounding bristles that includes (i) a filament advancing device constructed to receive the filament group from the guide structure and advance the group of filaments, comprising a first pair of jaws that are fixed against vertical movement, and a second pair of vertically movable jaws, each of said first and second pairs of jaws being movable between an open position in which the group of filaments is axially movable with respect to the jaws and a closed position in which the jaws grasp the group of filaments; (ii) an end-rounding device positioned to engage the ends of said elongated filaments when delivered by said guide structure and to end-round said ends; and (iii) a cutter constructed to cut said filaments at a predetermined distance from said end-rounded ends to form a cut bundle of bristles of predetermined length; (c) with the first pair of jaws in the open position, closing the second pair of jaws to grasp the group of filaments; (d) moving the second pair of jaws vertically to advance the group of filaments to an end-rounding device; (e) closing the first pair of jaws to grasp the group of filaments and thereby restrict radial movement of the filaments; (f) contacting the free ends of the filament group with the end-rounding device to end-round the group of filaments; and (g) cutting the filaments with the cutting device, to define a bundle of end-rounded bristles having a predetermined length.

In preferred embodiments, the cutting step is performed using a guillotine cutter and the end-rounding is performed using a belt end-rounder. The guide structure includes a guide tube constructed to gather the filaments into the group, and an advancement gripper constructed to grasp the group of filaments and move the group of filaments to a position in which their ends engage the end-rounding device. Preferred devices further include a transfer gripper constructed to engage the cut bundle and transfer the cut bundle to a predetermined location spaced from the device. When the continuous filaments are provided in the form of a hank wound on a spool, preferred devices further include a plurality of rollers over which said continuous filaments are passed, when said device is in use, the rollers being constructed to direct the filaments into the guide structure. The filament group includes a sufficient number of filaments to manufacture a plurality of toothbrushes. It is also preferred that the guide structure, filament advancing device, end-rounding device, and cutting device be substantially vertically aligned.

In a further aspect, the invention features a device for trimming and end-rounding bristles.

The method and device of the invention allow filaments to be trimmed and end-rounded easily prior to attachment to a brush. By trimming and end-rounding bristles prior to attaching the bristles to a brush, excellent end-rounding can be achieved due to the expanded ability to select the desired residence time and other parameters during end-rounding (if end-rounding is performed after tufting, the residence time often is determined by the speed of the tufting machine). Moreover, waste from trimming is reduced, and the efficiency of the brush manufacturing process can be dramatically improved.

In another aspect, the invention features a method of forming a toothbrush. The method includes trimming and end-rounding a plurality of filaments as described above to form bristles having a predetermined length, providing a toothbrush head, and mounting a plurality of the bristles on the toothbrush head.

The invention also features bristles having improved end-rounding characteristics. The shape of the bristle ends can be predetermined, e.g., the bristle ends can be shaped flat, half spherical, pencil point or any conical shape desired, depending on how the machine is configured, as would be understood by one skilled in the art.

The term "guillotine" as used herein refers to a blade that is constructed to shear through a plurality of filaments without substantial tearing of the filaments.

Other features and advantages of the invention will be apparent from the description of the preferred embodiment thereof, and from the claims.

DESCRIPTION OF THE PREFFERED EMBODIMENT

Figure 1:
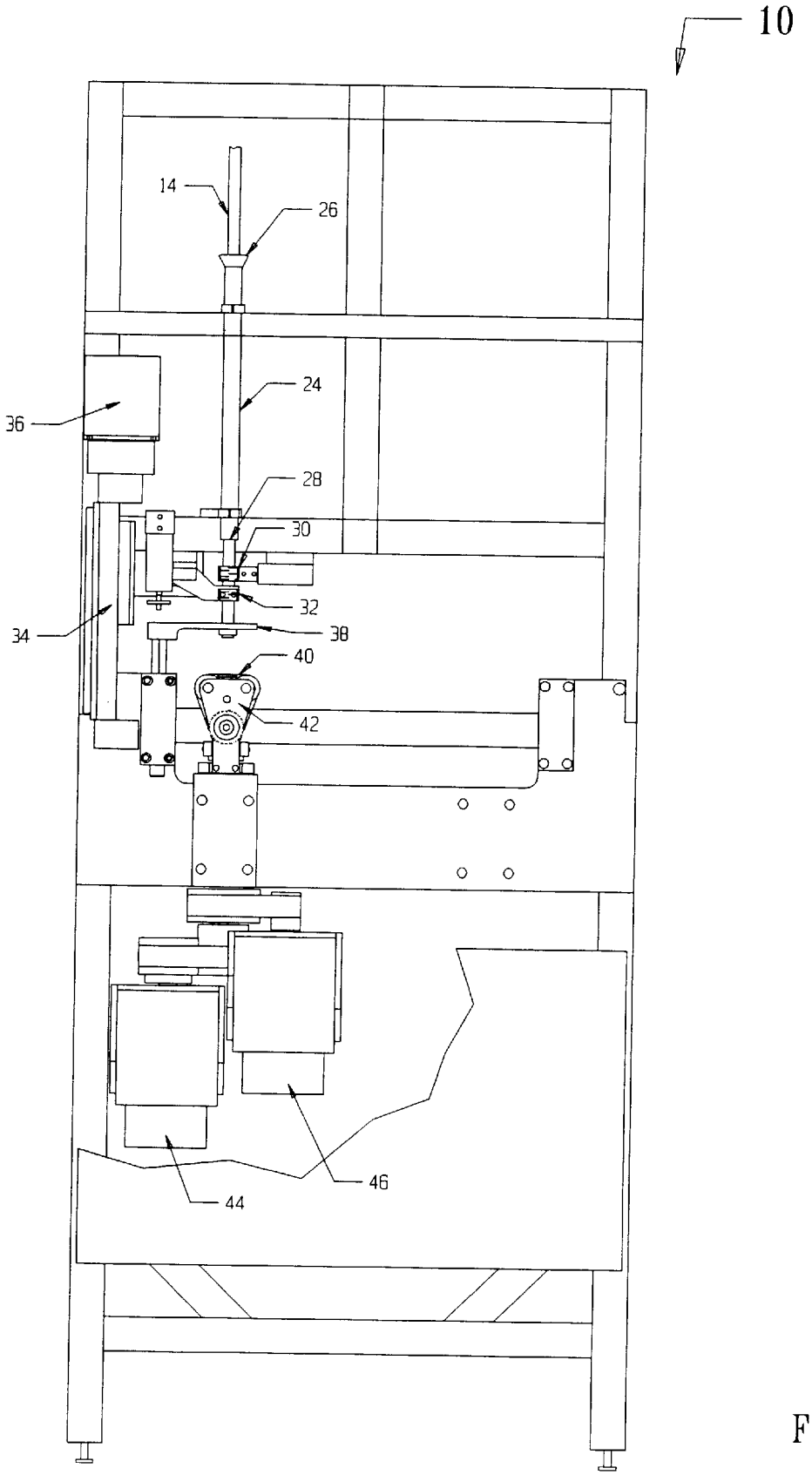
FIG. 1 is a schematic end view of a device according to one embodiment of the invention.
Figure 1A:
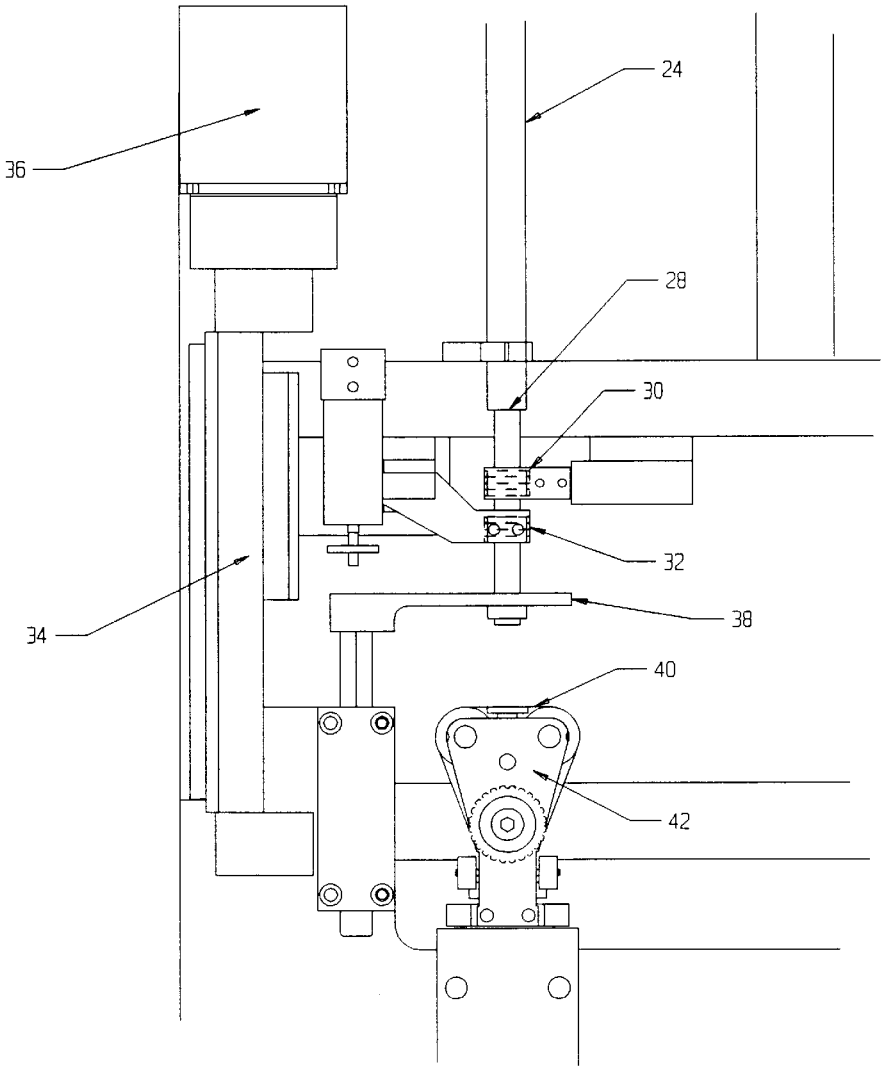
FIG. 1*a* is a detailed view of a portion of the device of FIG. 1 (for clarity, the cutter mechanism is omitted from FIG. 1*a*).
Figure 1B:
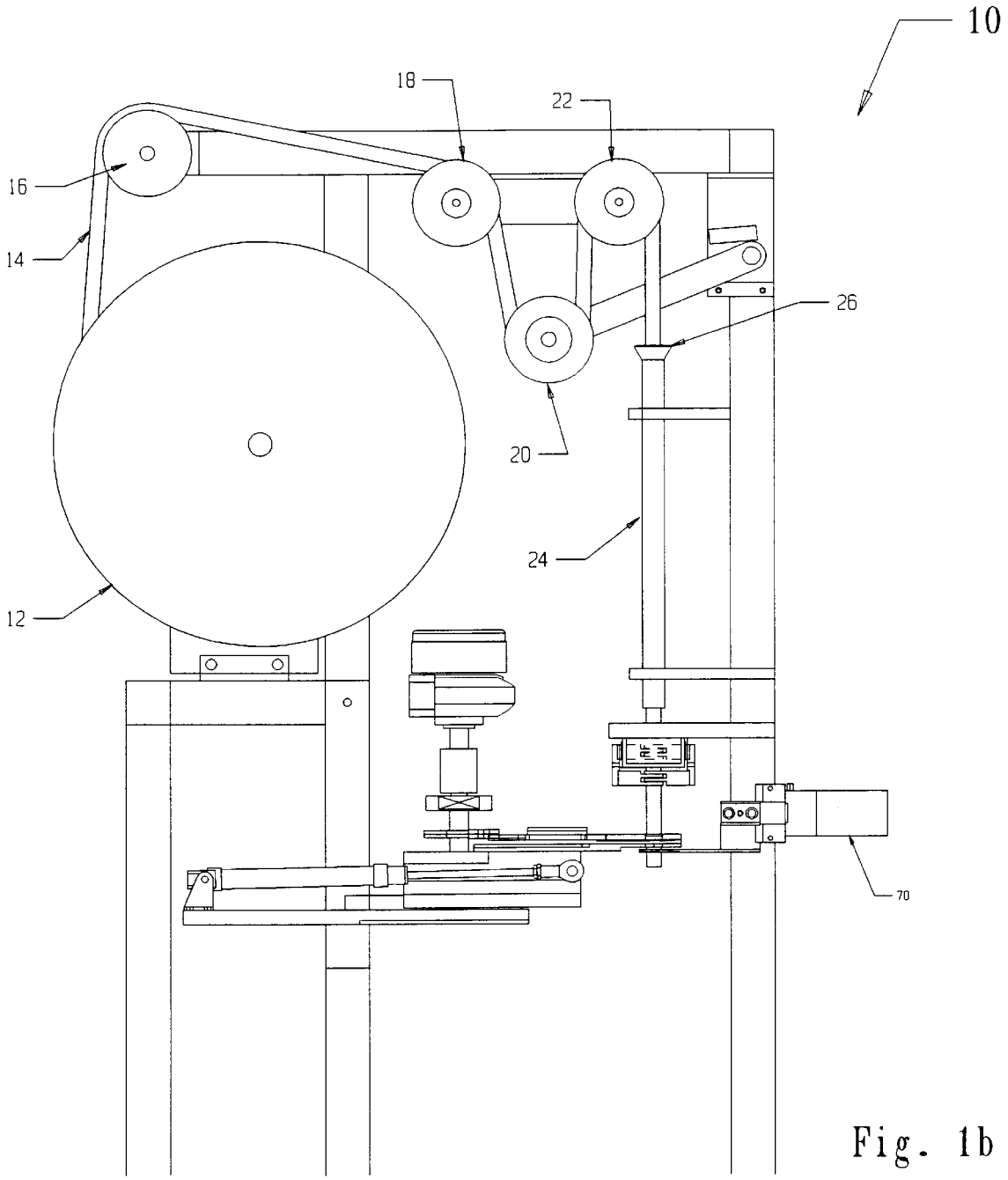
FIG. 1*b* is a side view of the device of FIG. 1, showing the feed path for elongated filaments wound on a spool.
Figure 1C:
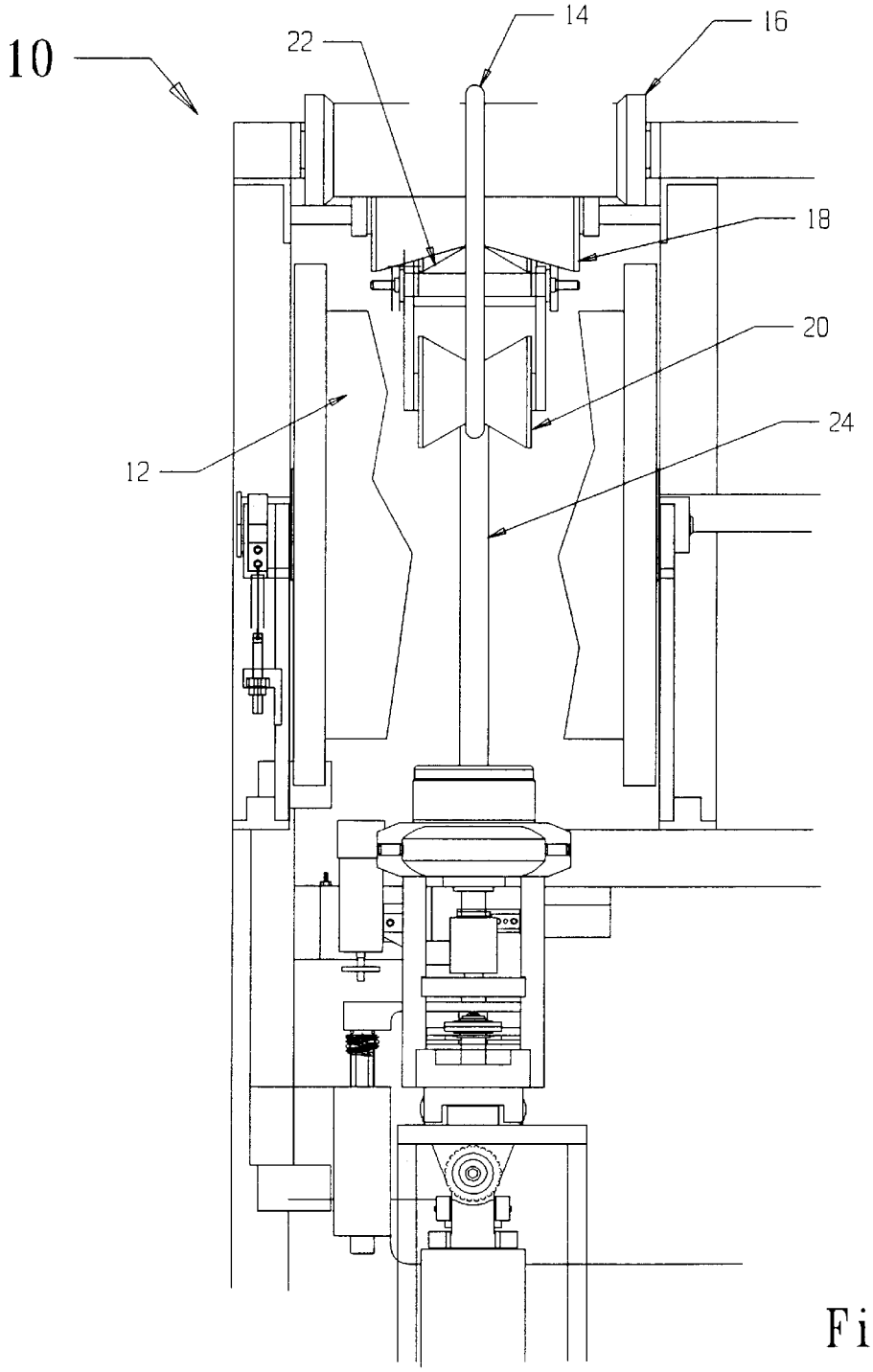
FIG. 1*c* is a detailed end view of the device, showing the feed path from above.

Referring to FIGS. 1–1*c*, a preferred device 10 includes a spool 12 (FIG. 1*b*) from which a plurality of continuous filaments 14 are drawn. From the spool 12, the filaments 14 pass through a series of guide rollers 16, 18, 20, 22. The rollers have a "bow-tie" shaped axial cross-section (see FIG. 1*c*), so that the filaments are directed together toward the center of the roller surface, gathering them together. To enhance this gathering effect it is preferred that the rollers further from the spool have a more steeply pitched "bow-tie" shaped cross-section than those that are closer to the reel, so as the filaments pass through the successive rollers they are gradually gathered more and more closely together. This arrangement has been found to effectively control "unruly" filaments as they are unwound from the spool and pass through the process, inhibiting the tendency of the filaments to bulk up and resist feeding.

Next, the gathered filaments 14 are fed into a guide tube 24 having a funnel-shaped portion 26 at its upper end to help guide and further gather the filaments as they enter the guide tube 24. To start the process, the filaments are fed through the guide tube until their gathered ends exit the lower end 28 of the guide tube and pass through hold grippers 30 and advancement grippers 32.

Figure 3:
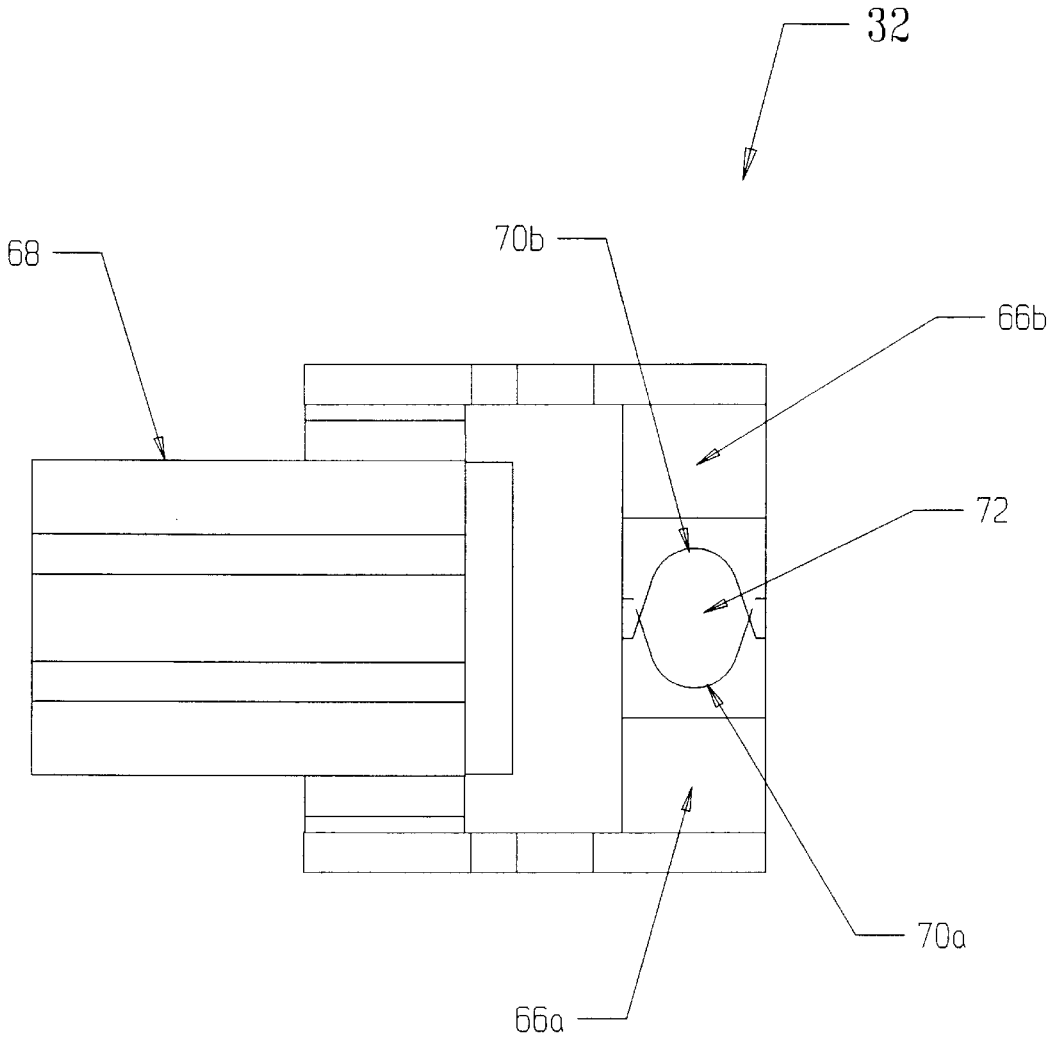
FIG. 3 is a top view of the advancement gripper used in the device of FIG. 1, in its open position.
Figure 3A:
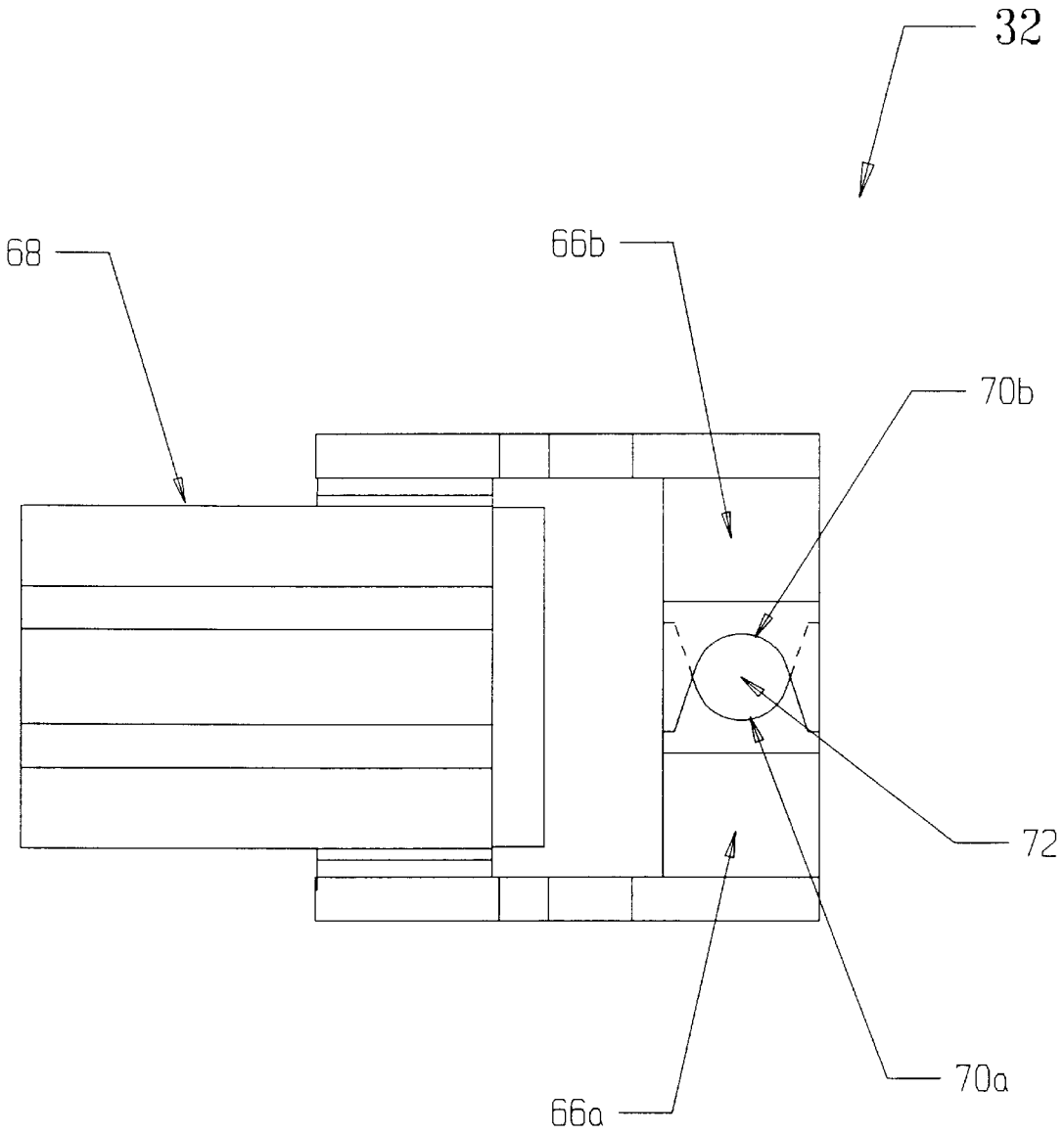
FIG. 3*a* shows the advancement gripper in its closed position.

The ends of the filaments are then grasped and held in this position by hold grippers 30 (FIGS. 1 and 1*a*). The advancement grippers 32 and hold grippers 30 are substantially identical and are shown in detail in FIGS. 3 and 3*a* and described below. The hold grippers 30 are mounted in a stationary position, and do not move in the vertical plane. The jaws of the hold grippers open and close, as shown in FIGS. 3 and 3*a*, respectively, to grasp or release the filament group.

At this point, the device has been prepared for use, and the filament group can now be cut into end-rounded lengths on a substantially continuous basis, i.e., without repeating the above initial feeding process.

The filament group 14 is next grasped by advancement grippers 32, and released by hold grippers 30. Advancement grippers 32, like hold grippers 30, are movable between the open and closed positions shown in FIGS. 3 and 3*a*. Advancement grippers 32 are also moveable between a plurality of positions in the vertical plane, e.g., a raised position (shown in FIGS. 1 and 1*a*) and several lowered positions, by a linear actuator. Preferably, the linear actuator includes a ball carriage 34 driven by an actuator 36 such as a servomotor or stepper motor. To continue feeding the filament group 14 through the device, advancement grippers 32 are next moved, still grasping the group, from the raised position to a lowered position. This feeds the filament group through the bottom guide 38. The bottom guide includes an aperture slightly larger than the diameter of the group, through which the group extends. Bottom guide 38 is movable between a raised, normal position, in which it is out of the way of the cutting device, and a lowered, guide position, in which it guides the filament group during end rounding. The bottom guide 38 is biased, e.g., spring-biased, towards its raised position (FIGS. 1 and 1*a*), and is pushed towards its lowered position by the driven advancement grippers 32. In its lowered position, bottom guide 38 is positioned at a predetermined height above the end-rounding device, selected to optimize the degree of "splay" of the bristles during end-rounding, as will be discussed below.

Immediately prior to, or during, the lowering of the filament group by the advancement grippers, belt end-rounder 40 is actuated, i.e., the two motors 44, 46 (FIG. 1) that drive the rotation of the belts of the end-rounder are turned on. It is preferred that the end-rounder be actuated prior to any contact with the filament ends, otherwise the filaments may tend to bend in an undesirable manner, e.g., kink, or to be forced back through the advancement gripper as the actuator advances the ball screw. If desired, the end-rounder may be operated continuously so that it is not necessary to coordinate turning the end-rounder on with lowering of the filament group.

Preferably, the hold gripper 30 is closed prior to engagement of the ends of the filament group with the belt end-rounder, to stabilize the filament group during end-rounding.

Figure 4:
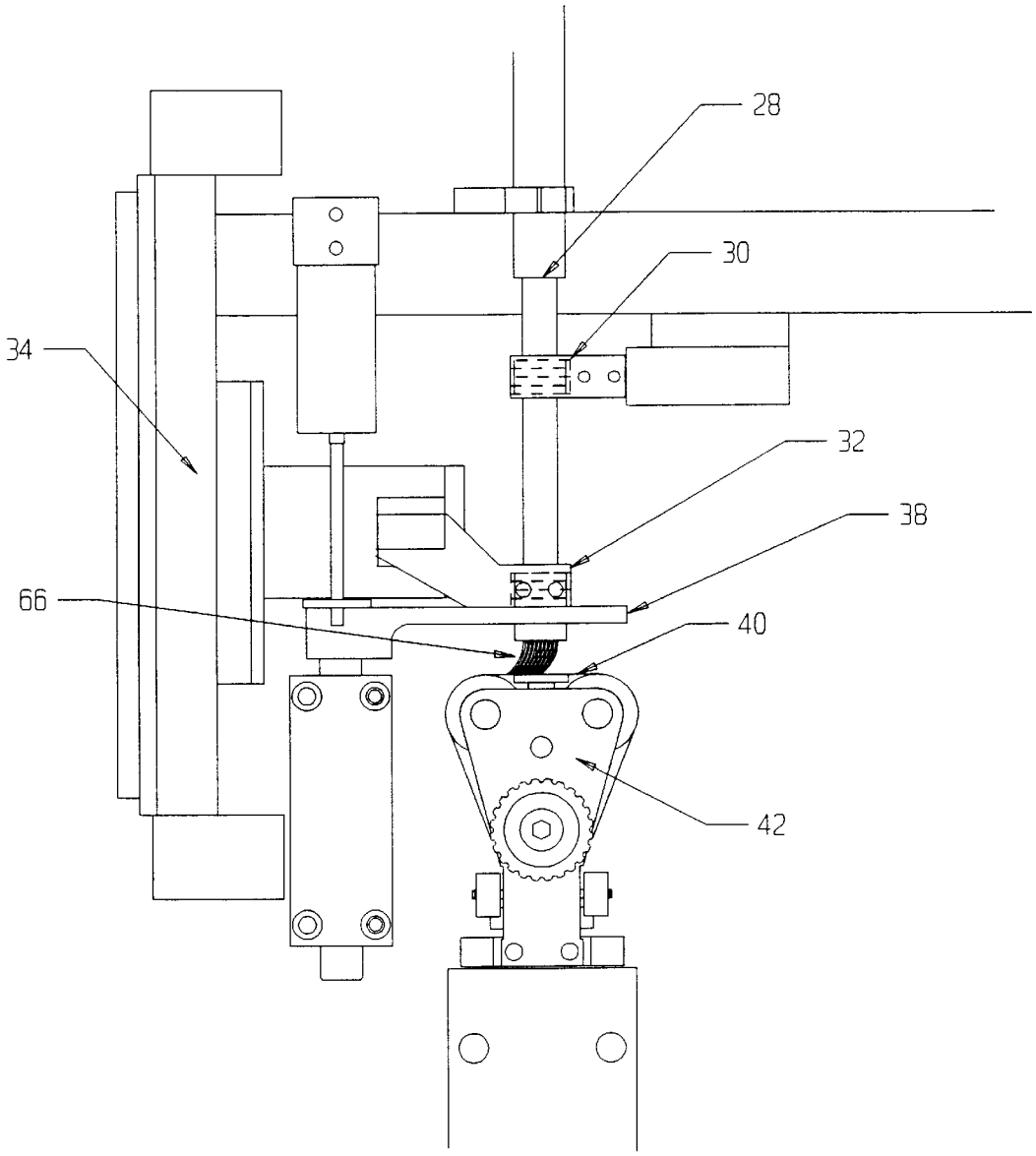
FIG. 4 is a schematic side view illustrating the splaying out of the filaments during contact with the end-rounding device.

When the ends of the filament group are brought into contact with belt 42 of the end-rounder, the ends splay out as shown in FIG. 4. The extent to which they splay outwardly will be at least to some degree determinative of the degree of end-rounding that can be achieved in a given amount of time. The extent of splay will be determined by several factors: (a) the length of the filament group that extends below the bottom guide 38, (b) the diameter of the group, as well as the diameter of the individual filaments, (d) the "interference distance" between the filament group and the belt, i.e., the amount by which the filament group would extend below the end-rounder belt if there were an aperture in the belt through which the group could extend (the filaments being instead deflected outwardly by pressure exerted against the belt), (e) the driven speed of the end-rounding belts, and (f) the surface roughness of the end-rounding belts. The driven speed will often be dictated by the speed required to keep pace with other steps in the brush manufacturing process. To obtain good end-rounding, it is desirable to have the filament ends "walk around in a circle" on the belt surface during end-rounding. If the filament ends do not move around the belt surface at all, generally the ends of the filaments will just be sanded flat, rather than end-rounded. The above factors can be adjusted empirically to obtain the desired degree of end-rounding by observing the resulting condition of the filament ends after completion of the process and varying any or all of these parameters as needed, as would be understood by one skilled in the art.

Preferably, a vacuum shroud is provided adjacent the end-rounding device, to remove the dust generated during end-rounding, as is well known in the art.

After the ends of the filament group 14 have been end-rounded, the filament group is raised to a predetermined position relative to the cutting device 48 by the advancement grippers 32 in preparation for cutting a length of the end-rounded filaments for use as bristles. The predetermined position is determined by the length of bristle that is desired.

When the filament group is in the desired position, it is grasped by the advance and hold grippers above the cutting device, and by a transfer gripper 70 (shown in detail in FIGS. 5, 5*a* and 5*b*) below the cutting device. Holding the filament group above the cutting device insures an accurate cut at the desired length. Additionally, the hold grippers maintain the desired filament position after cutoff. Grasping the filament group below the cutting device allows the cut portion of the group to be held together and transferred to another location, for example, to a filament magazine. In a toothbrush manufacturing process, the cut portion would be transferred to a filament magazine at a tufting station.

Figure 2:
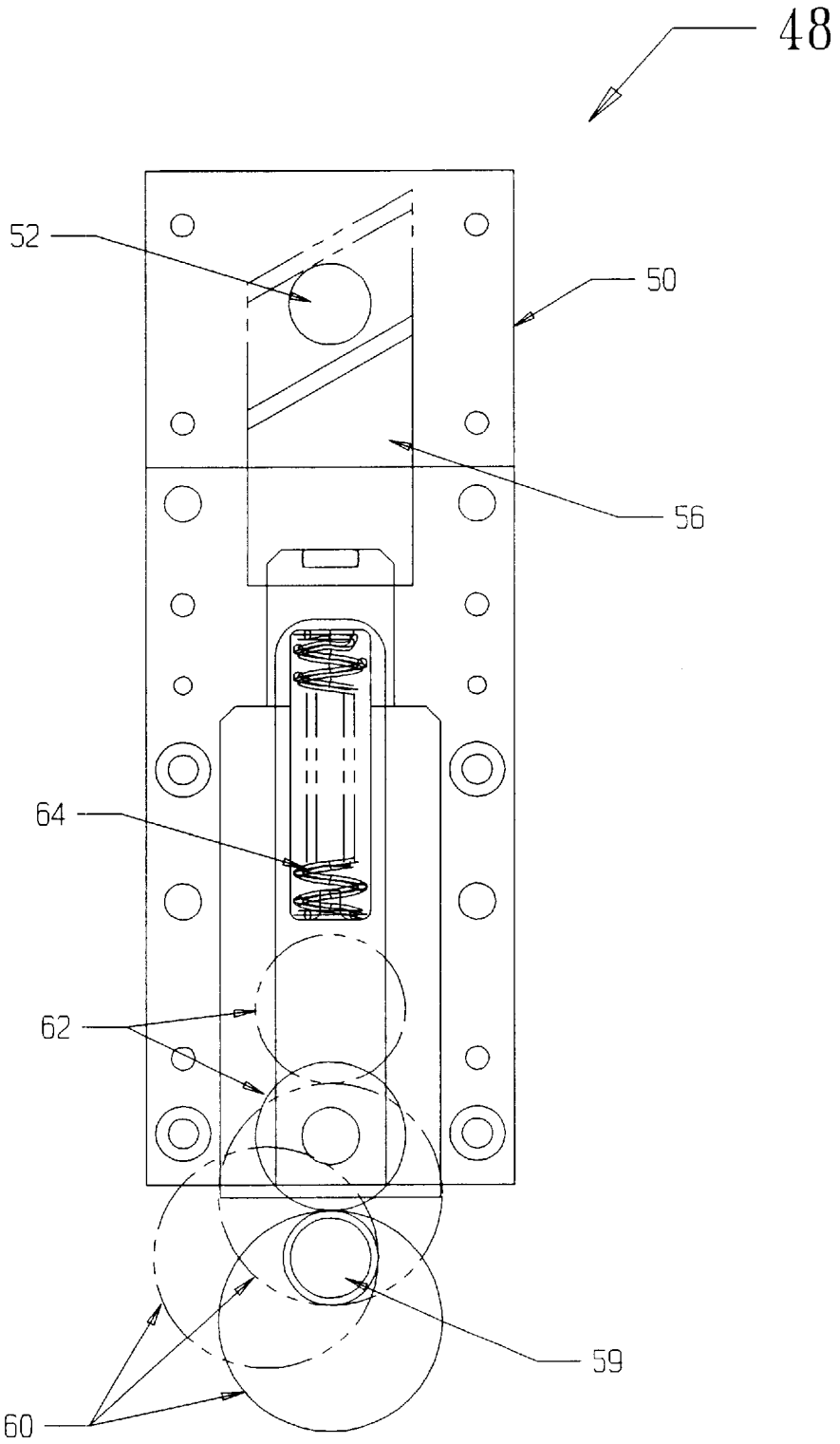
FIG. 2 is a schematic top view of the cutter mechanism of the device of FIG. 1.
Figure 2A:
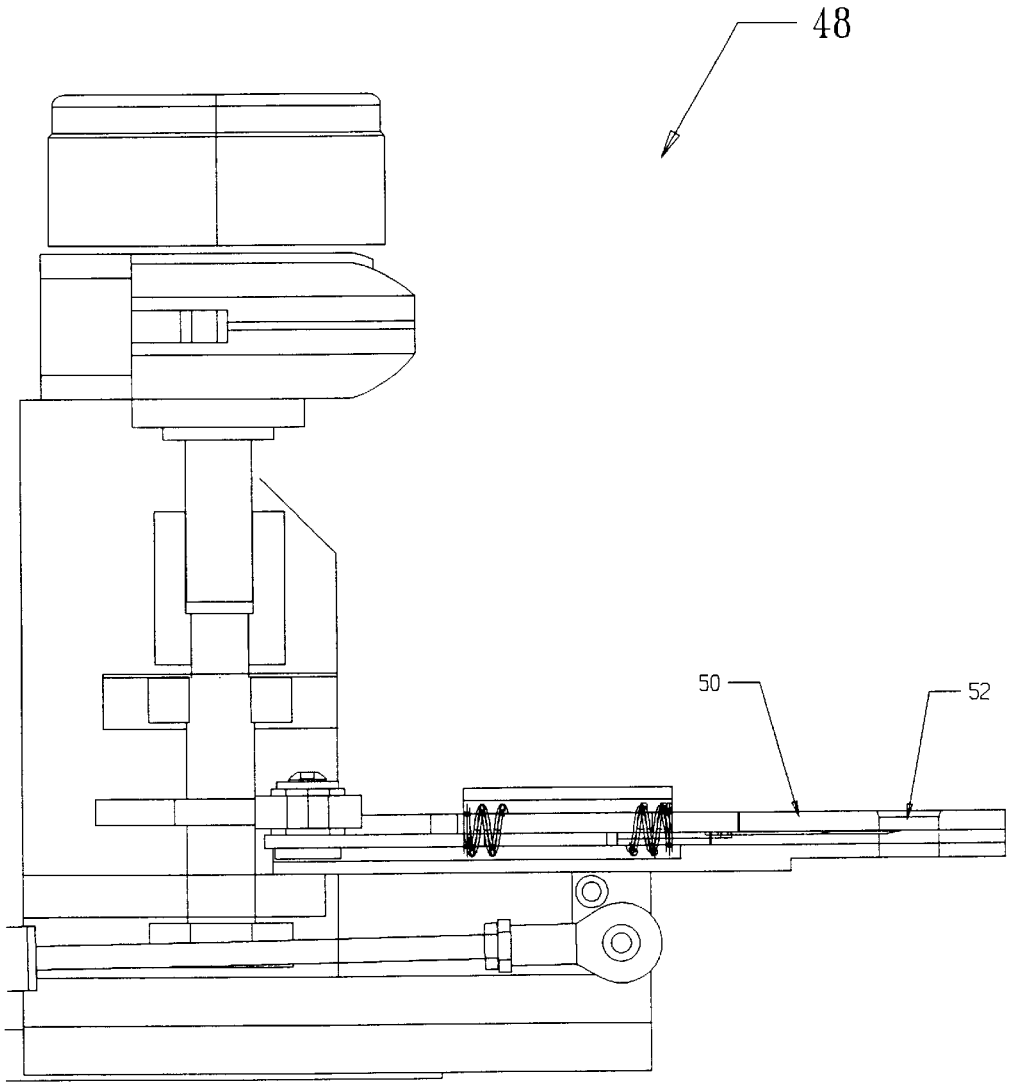
FIG. 2*a* is a side view of the cutter mechanism.
Figure 2B:
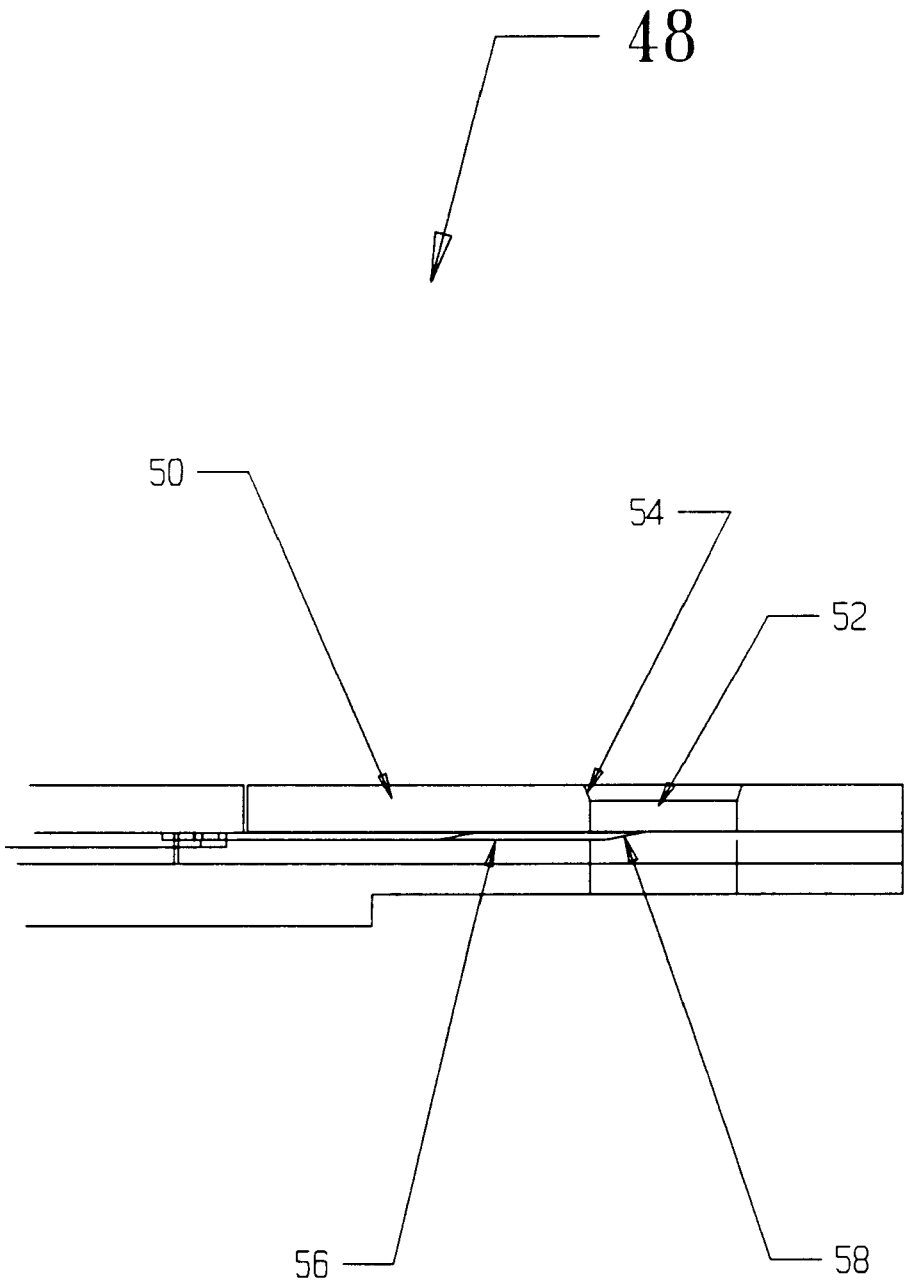
FIG. 2*b* is an enlarged detail view of a portion of the cutter mechanism.

The cutting device, shown in FIGS. 2–2*b*, is then actuated. Cutting device 48 includes a plate 50 having a cutting aperture 52 for receiving the filament group. Cutting aperture 52 includes a chamfer 54 which is angled to direct the filament ends into the aperture. Guillotine blade 56 reciprocates between a normal position (shown in solid lines in FIG. 2) and a cutting position (shown in phantom lines in FIG. 2) in the manner of a guillotine. The inventors have found that, by cutting the filaments in this manner, uniform flat ends are obtained without tearing of the filaments. This result remains relatively consistent even after minor blade wear occurs. Guillotine blade 56 includes an angled cutting edge 58 (FIG. 2*b*), to further ensure that the filaments will be sheared cleanly rather than torn.

The reciprocation of the guillotine blade is actuated by rotation of crankshaft 59 (FIG. 2), displacing eccentric cam 60 from the position shown in solid lines through the positions shown in phantom lines in FIG. 2. The eccentric cam, in turn, displaces bearing 62 against biasing spring 64 (which biases the guillotine blade 56 towards its normal position), forcing the guillotine blade forward through the filament group.

Figure 3B:
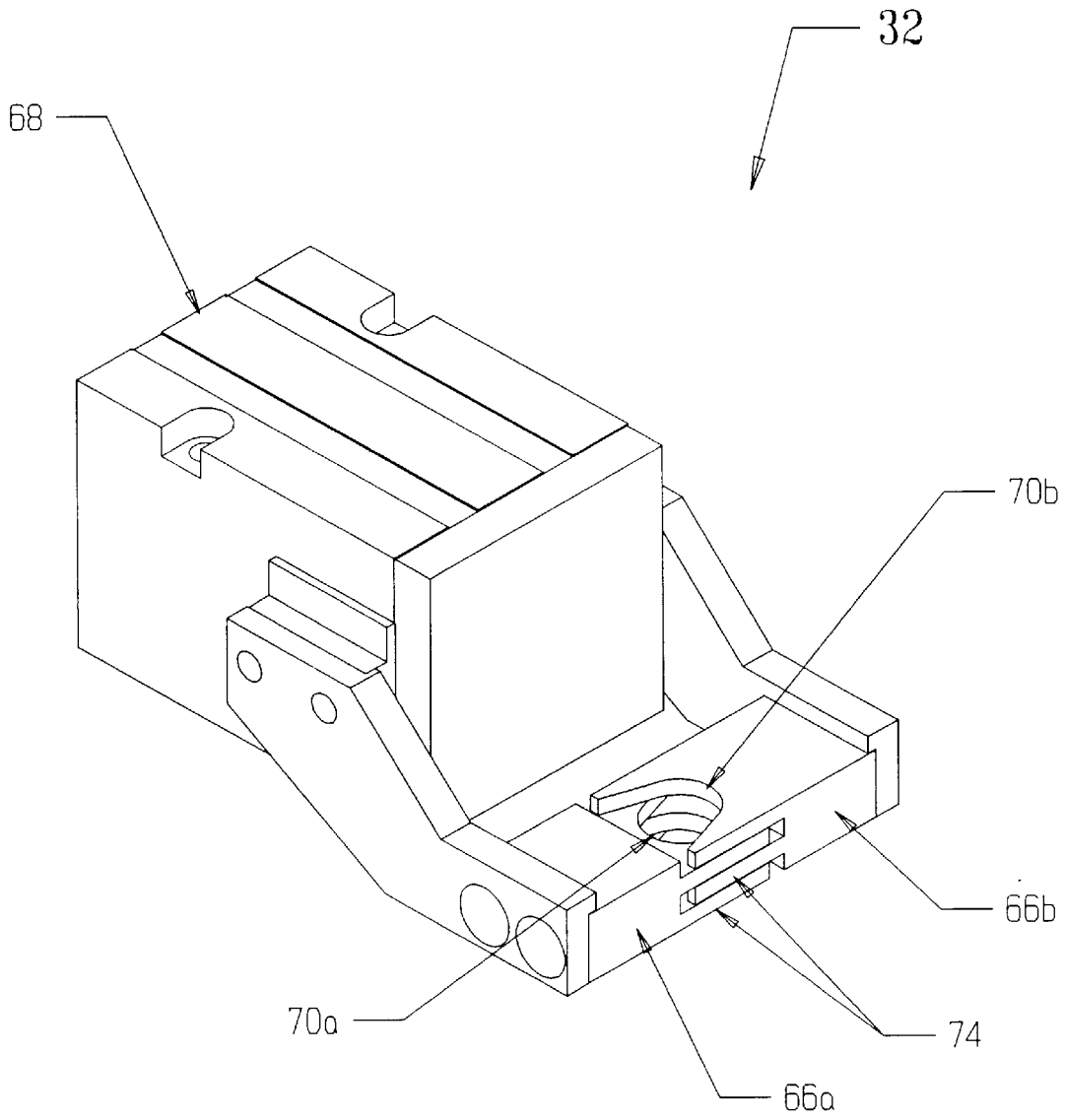
FIG. 3*b* is a perspective view of the advancement gripper in its closed position.

As noted above, the advancement gripper 32 and the hold gripper 30 are substantially identical. Accordingly, both are shown in FIGS. 3–3*b*. These figures will be described with reference to the advancement gripper, for convenience; the following description, however, applies to both grippers.

Advancement gripper 32 includes a pair of jaws 66*a*, 66*b*, that are moved between open (FIG. 3) and closed (FIGS. 3*a*, 3*b*) positions by a pneumatic gripper 68. Jaws 66*a*, 66*b* include arcuate portions 70*a*, 70*b* that together define an aperture 72 of variable diameter. When the advancement gripper is in its open position (FIG. 3), the diameter of aperture 72 is significantly greater than that of the filament group, allowing the gripper to be moved axially up and down the length of the filament group. When the advancement gripper is in its closed position (FIGS. 3*a*, 3*b*), the diameter of aperture 72 is substantially equal to the outer diameter of the filament group (in a compressed state), allowing the gripper to grasp the filament group securely. As shown in FIG. 3*b*, jaws 66*a*, 66*b* preferably include interlocking fingers 74 to enable the jaws to be moved between their positions in a controlled manner without less of filament containment.

Figure 5:
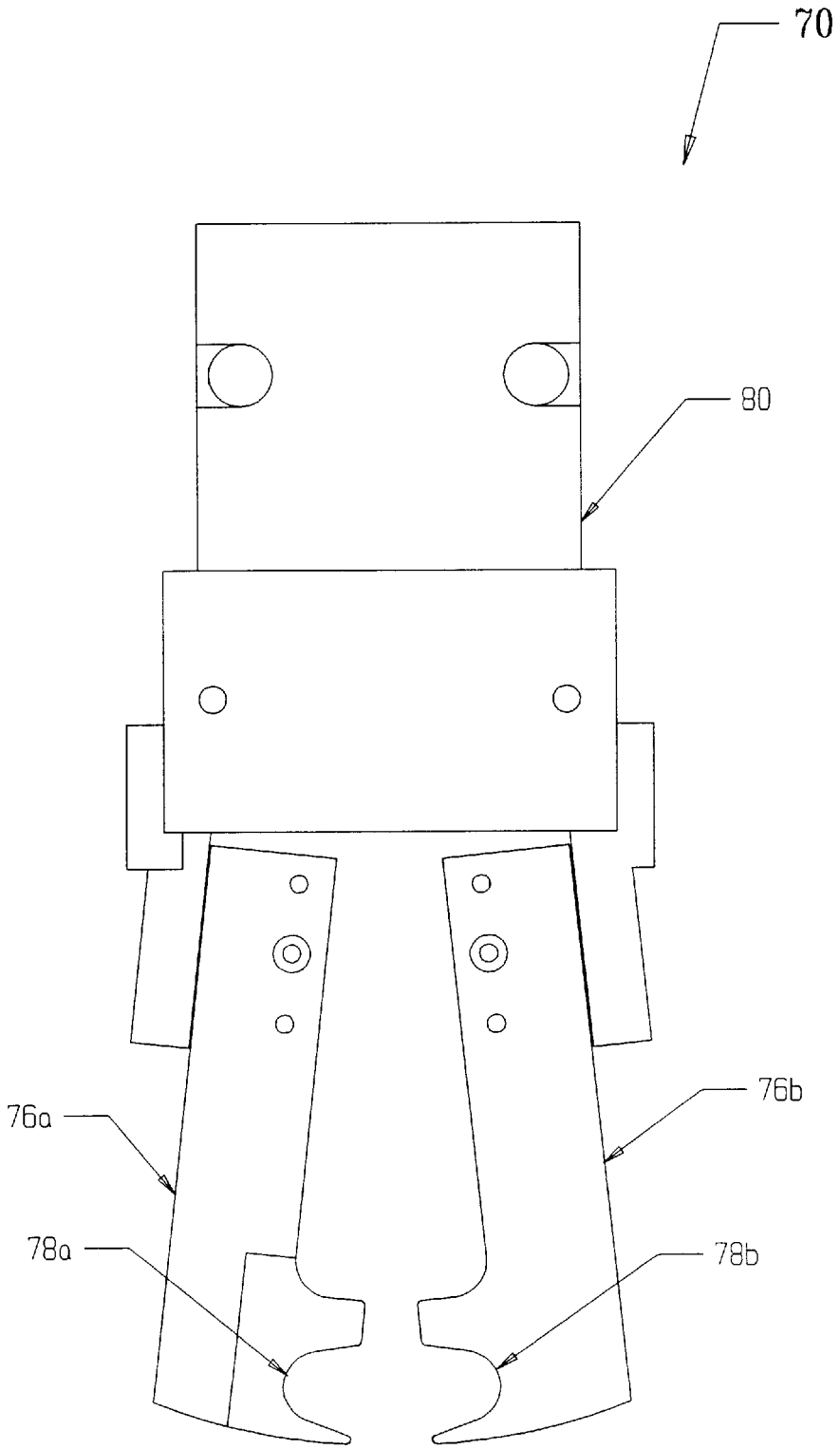
FIG. 5 is a top view in the open position.
Figure 5A:
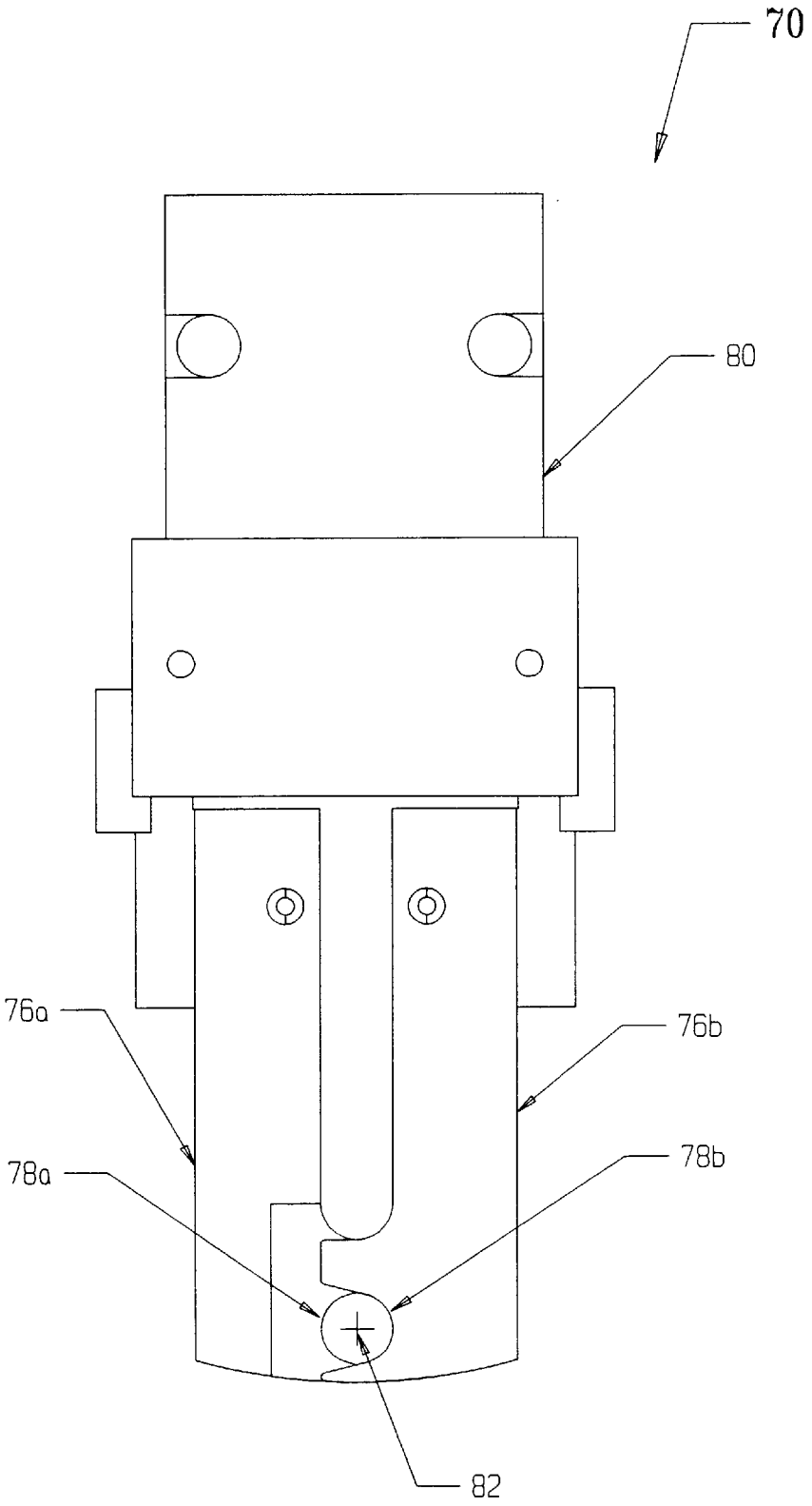
FIG. 5*a* is a top view in the closed position.
Figure 5B:
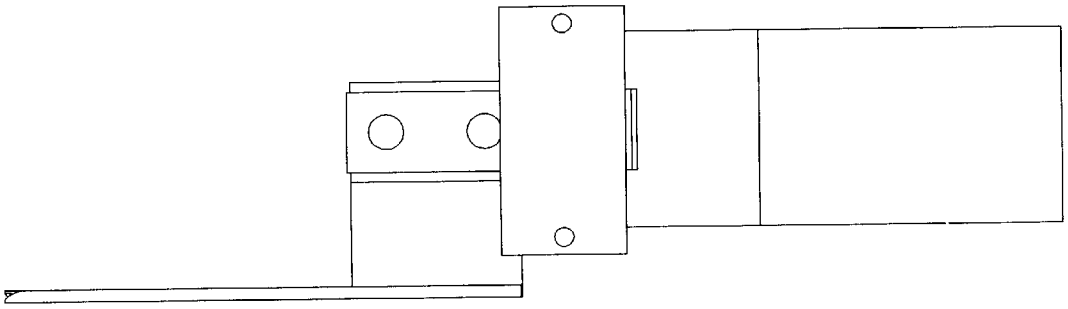
FIG. 5*b* is a side view, of the transfer gripper used in FIG. 1.

The transfer grippers 70, shown in FIGS. 5–5*b*, include a pair of jaws 76*a*, 76*b* that include arcuate portions 78*a*, 78*b*, and an actuator 80 that moves the jaws between an open position (FIG. 5) and a closed position (FIG. 5*a*). In the open position, the arcuate portions 78*a*, 78*b* are completely separated, i.e., do not define an aperture. In the closed position, the arcuate portions 78*a*, 78*b* define an aperture 82 having a diameter that is substantially equal to the outer diameter of the cut bundle, allowing the grippers 70 to firmly grasp the cut bundle.

The following example is intended to be illustrative and not limiting in effect.

EXAMPLE

Continuous filaments of 7 mil diameter nylon, wound on a spool, were fed through the device shown in FIG. 1 in the manner described above. The interference distance was approximately 0.090 inch. The abrasive medium (end-rounder belt) was 280 grit silicon carbide. The speed of the abrasive medium was approximately 70 inches/second, and the orbital speed of the end-rounder head (speed of rotation in the plane parallel to the plane defined by the ends of the filaments) was approximately 1000 rpm. The duration of contact of the filament end contact with the abrasive medium was approximately 8 seconds.

The ends of the filaments were examined after this procedure was completed, and the ends consistently exhibited the desired shape. In this case a half spherical end was desired.

Other embodiments are within the claims.

For example the end-rounding device need not be a belt end-rounder, as shown, but could instead be any other device that will produce end-rounding of the filaments chosen. Examples of other suitable end-rounding devices include but are not limited to belt end-rounders, drum end-rounders, chemical end-rounders (e.g., an acid bath), heat end-rounders and ultrasonic end-rounders.

Many types of filaments can be used, provided the filament has sufficient structural integrity to withstand the process, which can be easily determined empirically. When the bristles are to be used in toothbrush manufacture, the filaments would be selected to be suitable for such use. Suitable toothbrush bristle materials are well known to those skilled in the art.

In addition, although the filaments have been illustrated as being wound on a spool, the filaments could be provided in any desired manner, e.g., as an unwound hank. If the filaments were provided in a different manner, the feed path used would change (would no longer be the rollers illustrated in FIGS. 1–1*c*). For example, if an unwound hank of filaments were used, the filaments could be fed through an elongated tube.

What is claimed is:

1. A method for trimming and end-rounding bristles comprising:

(a) providing a group of elongated continuous filaments arranged so that the longitudinal axis of each of the filaments is substantially parallel to the longitudinal axes of the other filaments;

(b) providing a device for trimming and end-rounding bristles comprising:

a filament advancing device constructed to receive the filament group from the guide structure and advance the group of filaments, comprising a first pair of jaws that are fixed against vertical movement, and a second pair of vertically movable jaws, each of said first and second pairs of jaws being movable between an open position in which the group of filaments is axially movable with respect to the jaws and a closed position in which the jaws grasp the group of filaments;

an end-rounding device positioned to engage the ends of said elongated filaments when delivered by said guide structure and to end-round said ends; and a cutter constructed to cut said filaments at a predetermined distance from said end-rounded ends to form a cut bundle of bristles of predetermined length;

(c) with the first pair of jaws in the open position, closing the second pair of jaws to grasp the group of filaments;

(d) moving the second pair of jaws vertically to advance the group of filaments to an end-rounding device;

(e) contacting the free ends of the filament group with the end-rounding device to end-round the group of filaments; and (f) cutting the filaments with the cutting device, to define a bundle of end-rounded bristles having a predetermined length.

2. The method of claim 1 further comprising providing a third pair of jaws constructed to grasp the filament group below the cutting device, and, during step (g), grasping the filaments above the cutting device with at least one of the first and second pairs of jaws and grasping the filaments below the cutting device with the third pair of jaws to stabilize the filaments and cut bristles during and after cutting.

3. The method of claim 1 further comprising providing a third pair of jaws, constructed to grasp the group of filaments in a region below the cutting device, and grasping the group of filaments with the third pair of jaws prior to cutting the filaments.

4. The method of claim 1 further comprising providing a guide member, mounted above the end-rounding device, having an aperture dimensioned to receive the group of filaments, and inserting the group of filaments through the guide member to further restrict radial movement of the filaments.

5. The method of claim 1 further comprising providing said elongated filaments wound on a spool.

6. The method of claim 5 further comprising unwinding said elongated filaments from said spool.

7. The method of claim 6 wherein said unwinding step comprises passing the elongated filaments through a series of rollers constructed to gather the filaments into said group.

8. The method of claim 1 wherein said cutting step is performed using a guillotine cutting device.

9. The method of claim 1 further comprising selecting said predetermined length so that said bristle is suitable for use as a toothbrush bristle.

10. The method of claim 1 further comprising selecting said filament group to contain sufficient filaments to form a plurality of toothbrushes.

11. The method of claim 1 further comprising, between steps (d) and (e), closing the first pair of jaws to grasp the group of filaments and thereby restrict radial movement of the filaments.

12. A device for trimming and end-rounding bristles comprising:

a guide structure constructed to deliver a plurality of continuous elongated filaments in the form of a group arranged so that the longitudinal axis of each of the filaments is substantially parallel to the longitudinal axes of the other filaments;

a filament advancing device constructed to receive the filament group from the guide structure and advance the group of filaments, comprising a first pair of jaws that are fixed against vertical movement, and a second pair of vertically movable jaws, each of said first and second pairs of jaws being movable between an open position in which the group of filaments is axially movable with respect to the jaws and a closed position in which the jaws grasp the group of filaments;

an end-rounding device positioned to engage the ends of said elongated filaments when delivered by said guide structure and to end-round said ends; and a cutter constructed to cut said filaments at a predetermined distance from said end-rounded ends to form a cut bundle of bristles of predetermined length.

13. The device of claim 12 wherein said cutter is a guillotine cutter.

14. The device of claim 13 wherein said guillotine cutter comprises a blade having an angled surface which faces away from the direction from which the filament group is being delivered to the cutting device.

15. The device of claim 13 wherein said guillotine cutter comprises a cutting plate having a chamfered cutting aperture.

16. The device of claim 13 wherein said guillotine cutter comprises a crankshaft; an eccentric cam mounted on said crankshaft for movement between two positions in response to rotation of said crankshaft; and a guillotine blade mounted for movement, in response to displacement of said eccentric cam, from a first, retracted position, to a second, actuated position in which the blade shears through the group of filaments.

17. The device of claim 12 wherein each of said first and second pairs of jaws comprises opposing arcuate portions constructed to define an aperture of variable size.

18. The device of claim 17 wherein each of said first and second pairs of jaws comprises two opposing jaws, each jaw comprising a said arcuate portion and a plurality of spaced fingers, the fingers of one of the opposing jaws being positioned to interlock with the fingers of the other opposing jaw.

19. The device of claim 12 wherein said guide structure comprises a guide tube constructed to gather said filaments into said group.

20. The device of claim 19 wherein said guide tube includes a first end at which said group of filaments enters the guide tube, said first end having a funnel-shaped portion to direct the filaments into the guide tube.

21. The device of claim 12 further comprising a third pair of jaws constructed to engage the group of filaments below the cutter and to transfer the cut bundle to a predetermined location spaced from the device.

22. The device of claim 12 further comprising a plurality of rollers over which the group of filaments is passed, when the device is in use, said rollers being constructed to direct said filaments into said guide structure.

23. The device of claim 22 wherein said rollers each have a converging surface shaped to urge the filaments together as they pass over each roller.

24. A device for trimming and end-rounding bristles comprising:

a guide structure constructed to deliver a plurality of continuous elongated filaments in the form of a group arranged so that the longitudinal axis of each of the filaments is substantially parallel to the longitudinal axes of the other filaments and so that the ends of the filaments define a plane;

a filament advancing device constructed to receive the filament group from the guide structure and advance the group of filaments;

an end-rounding device positioned to engage the ends of said elongated filaments when delivered by said guide structure and to end-round said ends; and a cutter constructed to cut said filaments at a predetermined distance from said end-rounded ends to form a cut bundle of bristles of predetermined length;

wherein the guide structure, filament advancing device, end-rounding device, and cutting device are substantially vertically aligned.

* * * * *